US006415689B2

(12) United States Patent
Castellani et al.

(10) Patent No.: US 6,415,689 B2
(45) Date of Patent: Jul. 9, 2002

(54) CORKSCREW FOR A WINE STEWARD

(75) Inventors: Maurizio Castellani, Creazzo; Piero Claudio Burato, Montecchia di Crosara, both of (IT)

(73) Assignee: Prop 12 S.A.S. di Burato Piero Claudio e Castellani Maurizio & C., Vicenza (IT)

( * ) Notice: Subject to any disclaimer, the term of this patent is extended or adjusted under 35 U.S.C. 154(b) by 0 days.

(21) Appl. No.: 09/845,699

(22) Filed: Apr. 30, 2001

(30) Foreign Application Priority Data

May 22, 2000 (IT) ..... VI2000A0100

(51) Int. Cl.[7] ..... B67B 7/04
(52) U.S. Cl. ..... 81/3.47; 81/3.36
(58) Field of Search ..... 81/3.45, 3.55, 81/3.47, 3.56, 3.36, 3.37

(56) References Cited

U.S. PATENT DOCUMENTS 4,437,359 A * 3/1984 Dejoux et al. ..... 81/3.09
5,363,725 A * 11/1994 Cellini ..... 81/3.36
5,992,269 A * 11/1999 Puig et al. ..... 81/3.47
6,101,900 A * 8/2000 Miguel ..... 81/3.36
6,176,154 B1 * 1/2001 Puig et al. ..... 81/3.47

* cited by examiner

*Primary Examiner*—Eileen P. Morgan
*Assistant Examiner*—Joni B. Danganan

(57) ABSTRACT

The corkscrew for a wine steward is of the type which contains a helicoidal body (1) to be inserted in the cap of a bottle to be opened, this body being hinged to an element (2) of lengthened shape. The main feature of the invention resides in the fact that it also contains an apparatus (4) which is common to devices of this type, capable of opening caps having a crown and an extension (7), which substantially extends for the entire length of element (2), is hinged (7') to the apparatus (4). This extension makes it easier substantially for the user the operation of raising the cap and also allows the operator to open the bottle without touching with his hands the mouth of the bottle.

2 Claims, 4 Drawing Sheets

FIG. 8
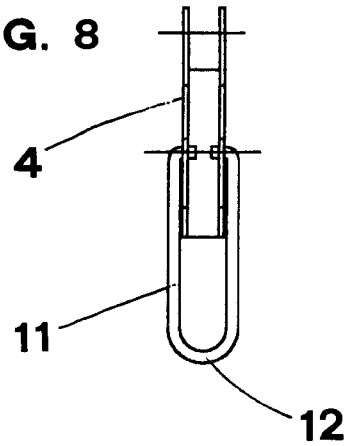
FIG. 9
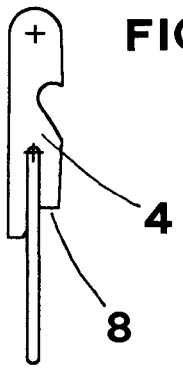
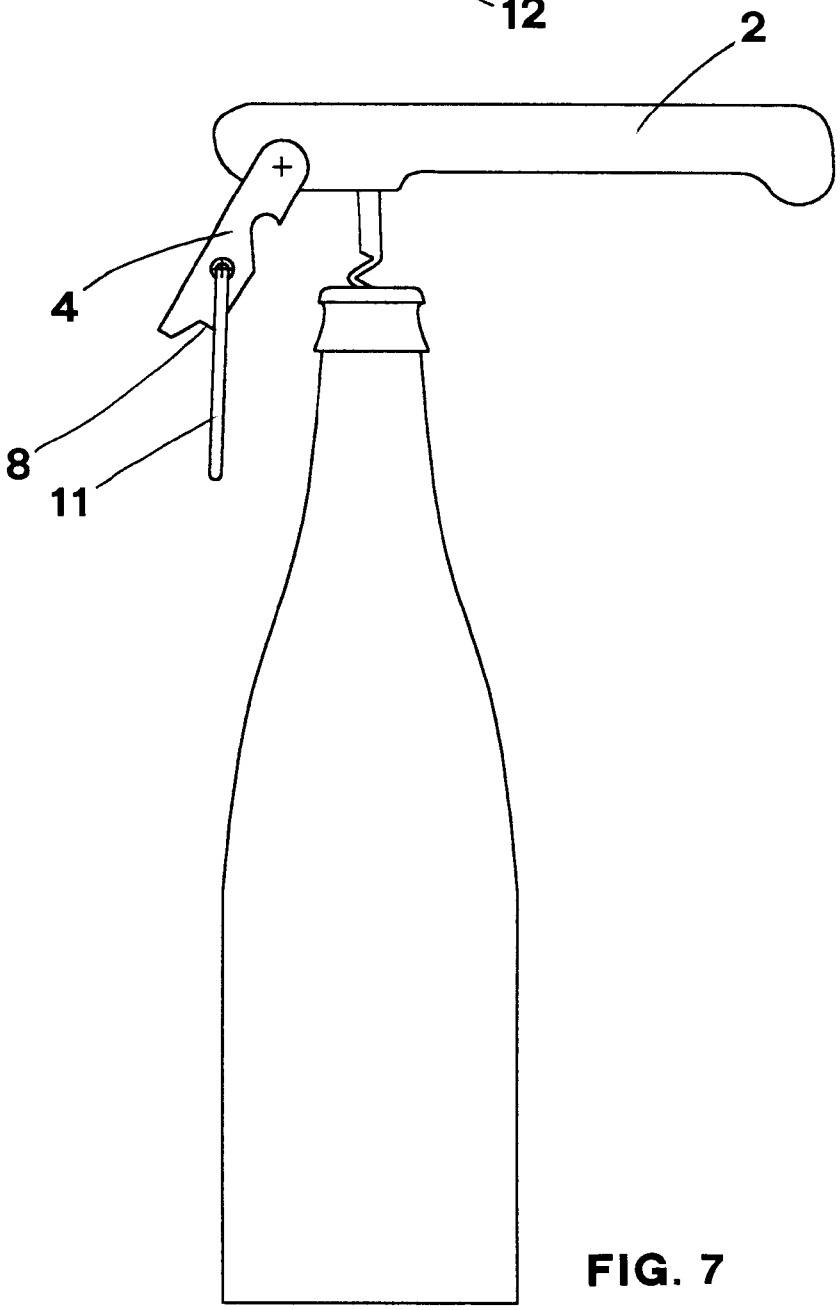
FIG. 7

CORKSCREW FOR A WINE STEWARD

FIELD OF THE INVENTION

The present invention relates to the field of corkscrews for a wine steward.

BACKGROUND OF THE PRIOR ART

It is known that the devices for removal of the bottle cap for a wine steward, commonly used in specialty shops, restaurants, bars and domestic environments, for the purpose of allowing the opening of bottles closed by caps which are operable by extraction from the neck of the bottles, comprise a helicoidal body to be inserted in the cap by screwing, these caps normally being made of cork, but recently are made of a plastic material.

This body is hinged to an element of lengthened shape which is placed in a position which is essentially parallel to the latter in a rest position but emerges from the latter in functioning conditions.

An apparatus is generally hinged to one of the extremities of the element of lenghtened shape, this apparatus being known and being capable of allowing the opening of caps with a crown, normally used for the closure of bottles of mineral water and other types of non-alcoholic beverages. This type of device for the removal of the cap is simple from the structural point of view and also from the functional point of view. In addition the devices are of extremely contained dimensions, particularly in rest conditions, so that the device may be easily placed even in the interior of a pocket of the waiter or wine steward and this is the reason which has led to success for the professional use.

In addition to these indisputable advantages, however, one must consider the fact that, with this type of device, the raising of the cap after the helicoidal body has been deeply inserted within the cap, is not particularly light. For the purpose of overcoming these drawbacks, many devices have been proposed, among which there are the devices described in EP-A-1063191 and Italian 1,302,529. These devices have not met with success from the commercial point of view, because of their constructive and functional complexity. In fact in order to carry out the raising of the cap, the operator must rest the extremity of the apparatus which is used for the opening of caps having a crown on the extremity of the neck of the bottle and therefore must provide for raising the element of lengthened shape, using as a hinging means the area of contact between the mouth of the bottle and the above mentioned apparatus.

The maneuvering requires a certain force and ability to be carried out, above all in the presence of caps of good quality which are strongly compressed in the interior of the neck of the bottle during the bottling phase, particularly because of the fact that it is necessary to carry out contemporaneously the raising of the element of lengthened shape and to maintain the contact of the apparatus with the bottle, which is carried out by the user by maintaining constantly the fingers of one hand in contact, contemporaneously with the apparatus and the neck of the bottle. Naturally, the fact that the user must rest the hand on the neck of the bottle, in an area very close to the mouth of the bottle, has contraindications of hygienic type which are increased due to the fact that the entire operation very frequently is directly carried out while the user is looking. For this reason, the user utilizes a napkin, a rag or similar materials to maintain reciprocal contact with the apparatus and the mouth of the neck of the bottle. In every case, the entire operation of raising the cap, because of the fact that there is nothing which would prevent the apparatus from disengaging from the surface of the bottle, compels the user to lengthen the time necessary for the good result of the operation, a fact which is not pleasent for a professional operator who operates in public.

In addition it happens sometime that the operator using the device for a wine steward causes the rupture of the mouth of the bottle which causes occasionally a wound of the hand of the operator, a fact which has resulted in unpleasant litigations for imdemnification of the damages by the owners of the commercial operations in which the operator and/or wine producers who have marketed bottles which have been broken.

SUMMARY OF THE INVENTION

The object of the present invention is to provide a device for the removal of the cap from a bottle of the type previously described which allows the operator to carry out an easy maneuver of extraction of the cap from the neck of the bottle without the necessity of resting the fingers of the hand on the neck of the bottle.

This object is achieved according to the invention by making available a device for a wine steward of the type described hereinabove, which, corresponding to the extremity of the apparatus is used to raise the caps having a crown, provides a step, perpendicularly to the transversal dimension of the apparatus so that the apparatus may rest on the upper border of the mouth of the bottle during the phase of raising the cap of the bottle.

There is also provided that to the apparatus is hinged an element which has a width measured in the direction perpendicular with respect to the greater dimension of the same element but smaller with respect to the dimension of the apparatus.

According to a preferred embodiment of the invention there is provided that the element hinged to the apparatus be constituted of an extension which, after it is aligned to the apparatus, allows the total length of the apparatus and the extension be essentially equal to the length of the element of the lengthened shape.

When the apparatus rests on the mouth of the bottle there is provided that the surface turned towards the neck of the bottle of the extension mentioned hereinabove enclose the neck of the bottle, whereby the operation of extraction of the cap is carried out without the necessity for the operator to touch the neck of the bottle with his hands.

This and other characteristics of the invention will be described in detail by reference to particular forms of achievement, provided as non-limiting examples, by reference to the accompanying drawings of which:

FIG. 7 illustrates a second embodiment of the invention applied to the cap of a bottle of opening a bottle;

FIGS. 8 and 9 show two views of the second form of achievement of the device of the invention;

Figure 1:
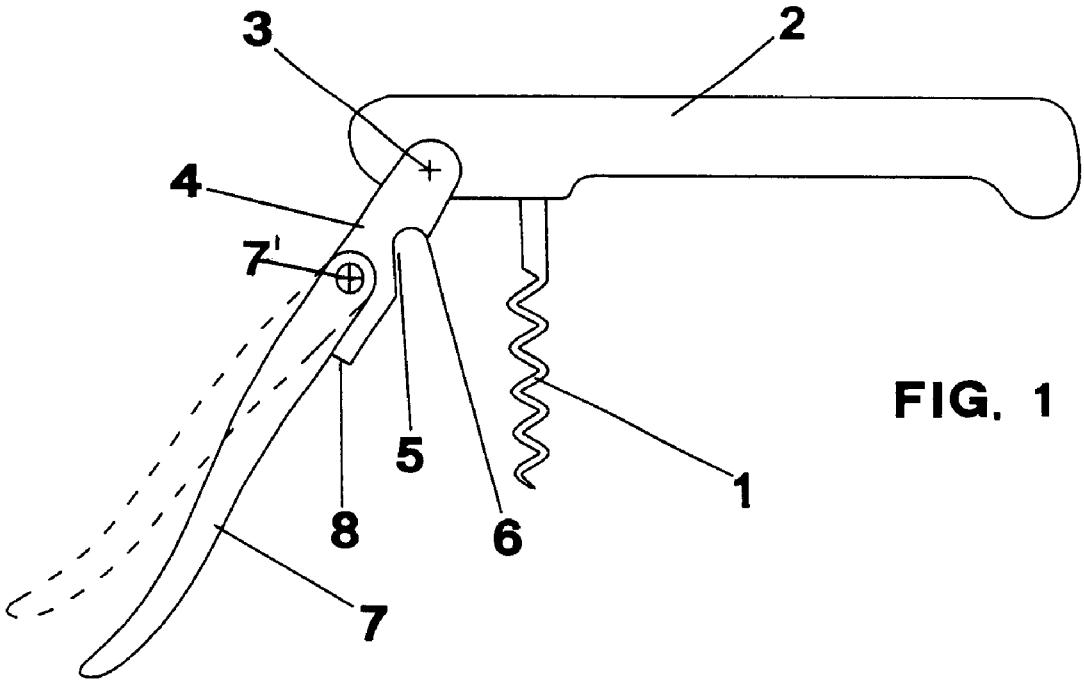
FIGS. 1–3 show side views of a first form of achievement of the device of the invention, respectively in position open, semi-open and closed.
Figure 2:
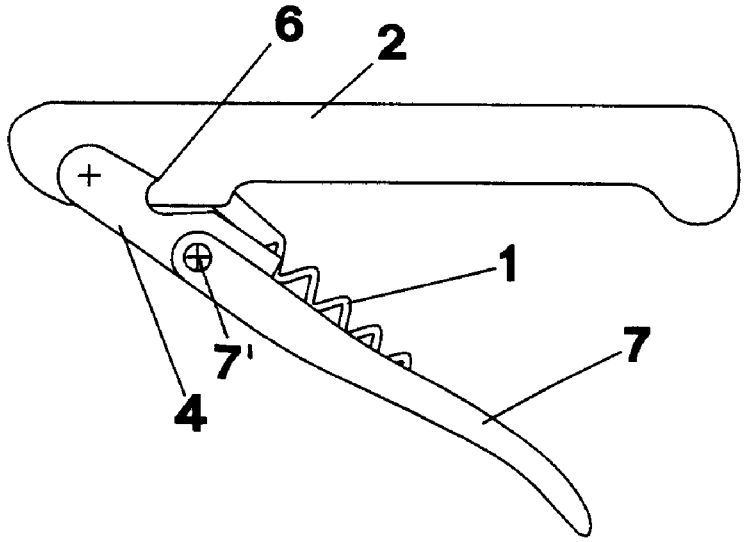
Figure 3:
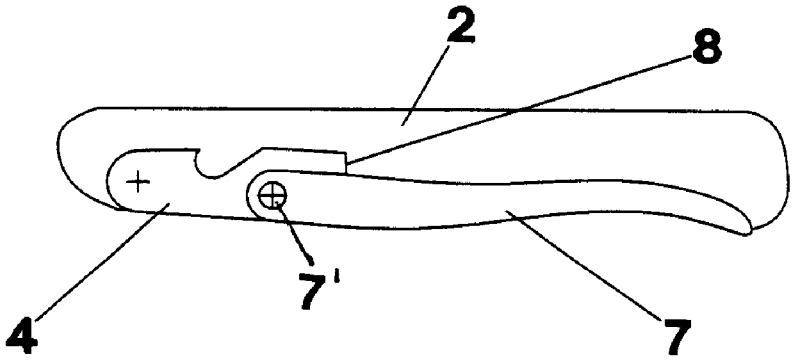
Figure 6:
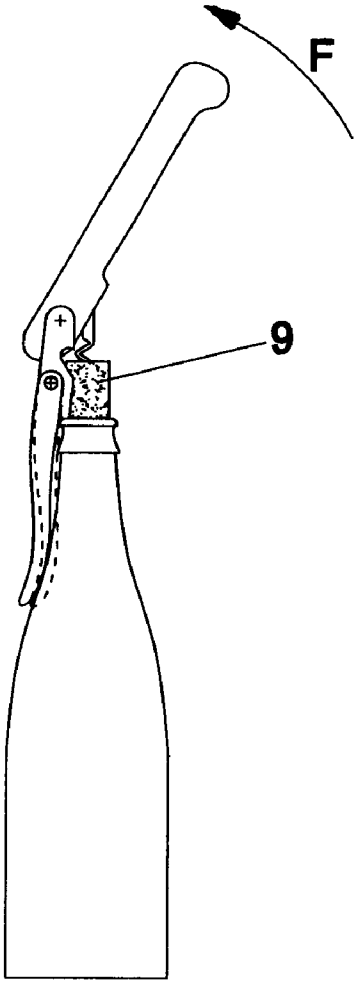
FIGS. 4, 5 and 6 show the same forms of achievement of the device in three different phases of opening a bottle.

As shown in FIGS. 1–3, the invention is constituted by a device for the extraction of the cap for a wine steward which comprises in the usual manner, a helicoidal body (1), to be inserted into the cap, which body is hinged to an element (2)

of lengthened form. The apparatus (4) is hinged to one of the extremities (3) of element (2). The apparatus (4) is of known type. Cavity (5) which ends with a pointed border (6) is present in the apparatus. The border (6) is used to engage with the borders of a cap having a crown which borders have a saw-toothed edge so as to determine its raising and therefore the opening of the bottle closed by the cap.

In the first embodiment of the invention the device of the invention provides for extension (7) to be hinged at (7') with the apparatus (4) and extending substantially along the entire length of element (2). This extension has a width measured in a transversal direction with respect to the greater dimension of the prolongation, and inferior to the width of the apparatus (4), so as to form step (8) which is perpendicular with respect to said greater dimension.

Figure 4:
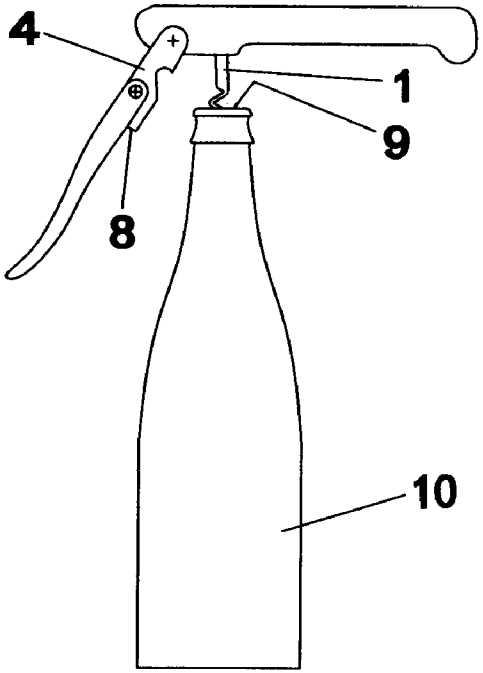

As shown in FIG. 4, the phase of insertion of the helicoidal body in the cap (9) of bottle (10) is identical to the devices of known type. In practice it is sufficient to place sufficiently the helicoidal body perpendicularly with respect to element (2), keeping the apparatus (4) moved away from the bottle.

After sufficient screwing of the helicoidal body in the cap, the apparatus (4) and its prolongation (7) are placed in contact with the neck of the bottle so that step (8) is placed in contact with the upper mouth of the bottle. In this situation, element (2) is not arranged horizontally but it is inclined with respect to a horizontal line, as shown in FIG. 5.

Figure 5:
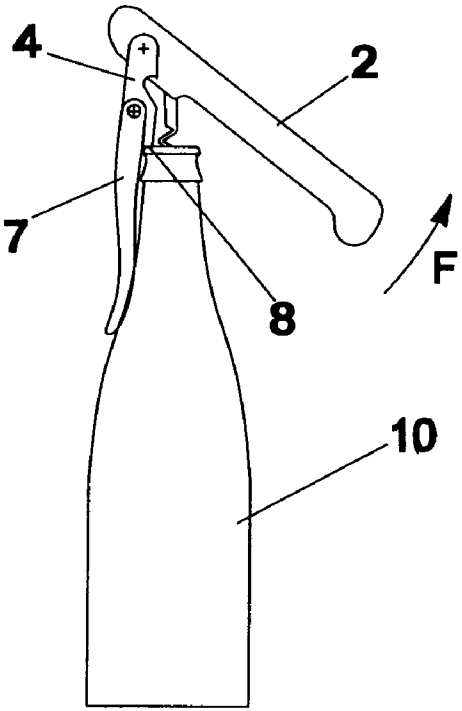

At this point it is sufficient to exert force on the portion of element (2) opposite to the portion in which apparatus (4) is hinged according to the direction of arrow F, shown in FIG. 5, resting on the upper mouth of the bottle (10), taking advantage of its contact with step (8).

In the meantime the prolongation (7) which is capable of rotating lightly around pin (7'), causes a sure contact of the entire device with the upper part of the neck of the bottle, which does not require to be necessarily grasped by the user, a matter which would cause the drawbacks discussed hereinabove.

In every case, the contact will not occur on the upper part of the mouth of the bottle, but will occur in the area in the lower extremity of extension (7), and this is a sure and hygienic position.

Figure 12:
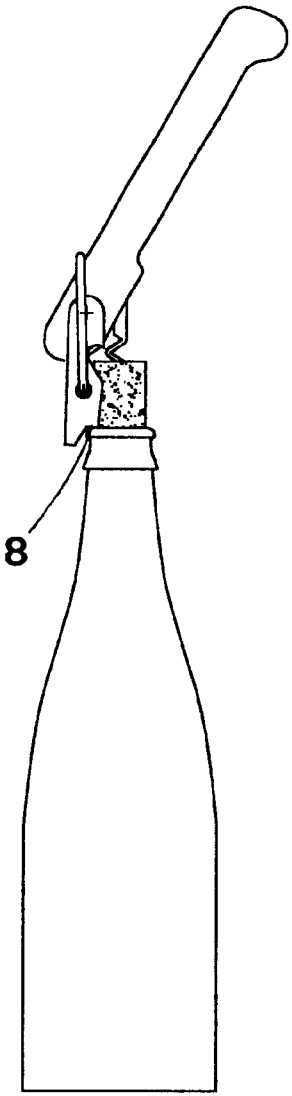
FIGS. 10, 11 and 12 show the second form of achievement of the invention in three different phases of opening a bottle.
Figure 10:
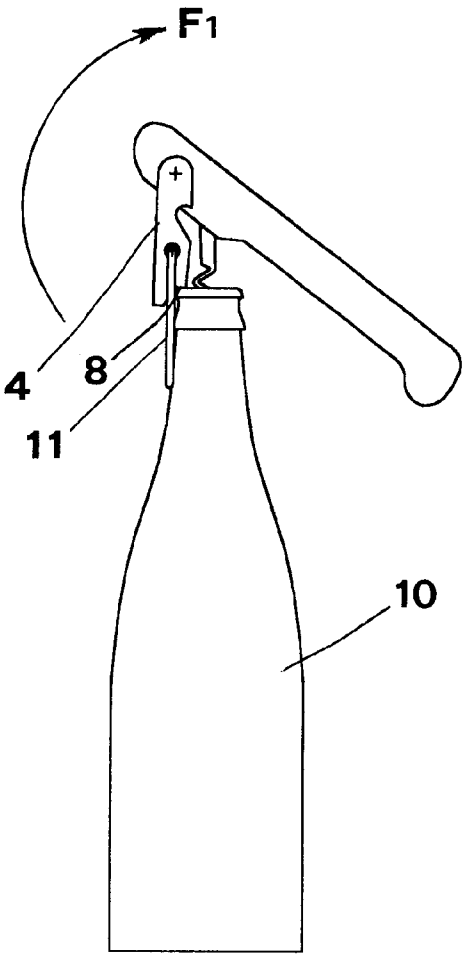

FIGS. 7, 8 and 9 show a second embodiment of the invention in which element (11) is hinged to the apparatus (4). Element (11) is essentially shaped in the form of a U. The position of element (11), as shown in FIGS. 10, 11 and 12, may vary from a position aligned with the apparatus (4), as shown in FIG. 10, to the position shown in FIG. 11, in which the curved portion (12) surrounds body (2) and climbs on top of the area corresponding to which apparatus (4) and body (2) are hinged.

Figure 11:
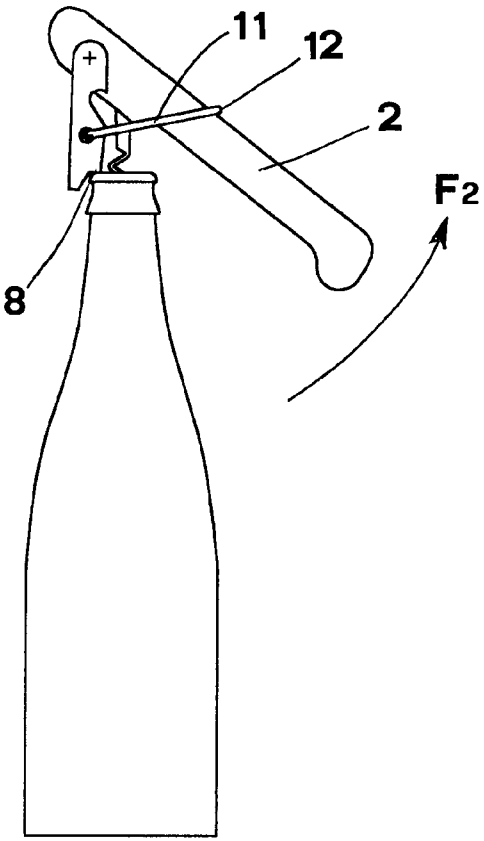

In actual practice, by using this device, the operator, after step (8) is placed in contact with the mouth of the bottle (10), causes element (11) to carry out a rotation according to arrow (F1) to reach the position shown in FIG. 11. Subsequently the operator provides for element (2) to rotate in direction shown by arrow F2, a fact which ensures the raising of the cap. The entire operation may be carried out without requiring the operator to surround the neck but only the lower part of the bottle, so that the operation is sure and hygienic.

On the basis of what has been shown, it is evident that the device of this invention allows to reach the object previously mentioned permitting in particular a sure and hygienic maneuver for opening bottles closed with a cap made of cork, and further the device is simple from both the constructive and functional point of view.

What is claimed is:

1. A corkscrew for a wine steward comprising a helicoidal body (1) insertable into a cap (9) by screwing, an element (2) of elongated shape to which said helicoidal body is hinged so that in the rest condition said body is in a position essentially parallel to said element (2) but emerges therefrom during functioning, said element (2) having two extremities, an apparatus (4) hinged to one extremity (3) of said element (2) and usable for opening caps having a crown, a step (8) formed on an extremity of said apparatus (4) perpendicular to the longitudinal dimension of said apparatus (4), and an element (7) hinged to said apparatus (4) and forming therewith when aligned a prolongation substantially equal to the length of element (2), the width of said element (7) perpendicular to the longitudinal dimension thereof being smaller with respect to the corresponding dimension of said apparatus (4) whereby said step (8) is capable of resting on the upper border of a mouth of a bottle (10) during the phase of raising said corkscrew.

2. A corkscrew for a wine steward comprising a helicoidal body (1) insertable into a cap (9) by screwing, an element (2) of elongated shape to which said helicoidal body is hinged so that in the rest condition said body is in a position essentially parallel to said element (2) but emerges therefrom during functioning, said element (2) having two extremities, an apparatus (4) hinged to one extremity (3) of said element (2) and usable for opening caps having a crown, a step (8) formed on an extremity of said apparatus (4) perpendicular to the longitudinal dimension of said apparatus (4) and an element (11) hinged to said apparatus (4) and constituted by an element essentially in the shape of a U, the position of said element being variable from a position aligned with apparatus (4) to a position whereby the curved portion (12) of said U surrounds said element (2), extending over the area corresponding to the hinging of apparatus (4) and element (2).

* * * * *